United States Patent [19]

Glatthorn

[11] 4,216,893

[45] Aug. 12, 1980

[54] APPARATUS FOR REMOTELY REPAIRING TUBES IN A STEAM GENERATOR

[75] Inventor: Raymond H. Glatthorn, St. Petersburg, Fla.

[73] Assignee: Westinghouse Electric Corp., Pittsburgh, Pa.

[21] Appl. No.: 908,046

[22] Filed: May 22, 1978

Related U.S. Application Data

[63] Continuation of Ser. No. 775,676, Mar. 8, 1977, abandoned.

[51] Int. Cl.[2] ..... B23K 37/02

[52] U.S. Cl. ..... 228/45; 29/726; 228/119; 165/76; 414/728

[58] Field of Search ..... 228/45, 29, 119, 183; 29/157.3 C, 157.4, 157.5, 401 R, 726; 214/1 BB, 1 BC, 1 BD, 1 CM

[56] References Cited

U.S. PATENT DOCUMENTS

| | | | |
|---|---|---|---|
| 2,482,490 | 9/1949 | Kaas | 29/157.5 X |
| 3,203,479 | 8/1965 | Hindman | 29/401 R X |
| 3,275,795 | 9/1966 | Bosna et al. | 219/60 A X |
| 3,740,820 | 6/1973 | Tarves, Jr. | 29/401 R |
| 3,913,752 | 10/1975 | Ward et al. | 214/1 BB |
| 3,927,295 | 12/1975 | Schuster et al. | 219/60 A X |
| 3,934,731 | 1/1976 | Muller et al. | 214/1 BB |

*Primary Examiner*—Francis S. Husar
*Assistant Examiner*—K. J. Ramsey
*Attorney, Agent, or Firm*—F. J. Baehr, Jr.

[57] ABSTRACT

Apparatus that is assembled quickly inside a channel head of a steam generator and is capable of performing various repair and inspection techniques remotely in order to reduce radiation exposure and facilitate rapid repair of the tubes.

9 Claims, 13 Drawing Figures

APPARATUS FOR REMOTELY REPAIRING TUBES IN A STEAM GENERATOR

This is a continuation of application Ser. No. 775,676 filed Mar. 8, 1977 now abandoned.

BACKGROUND OF THE INVENTION

This invention relates to nuclear steam generators, and more particularly, to apparatus for remotely repairing the tubes in a nuclear steam generator.

In pressurized water nuclear reactors primary fluid or coolant is pumped through a reactor and a steam generator, radioactive contaminants in the primary fluid are deposited on the tubes and in the channel head of the steam generator so that repair crews are subjected to significant radioactivity when working within the channel head. Therefore, in order to reduce the exposure of personnel to radiation, it is desirable to provide an apparatus which can be remotely operated and effectively inspect and repair tubes within the steam generator.

SUMMARY OF THE INVENTION

In general, apparatus for remotely repairing tubes disposed in a tube sheet in a channel head of a steam generator having a manway disposed in said head, when made in accordance with this invention, comprises a column rotatably disposed in the head generally perpendicular to the tube sheet, a boom pivotally mounted on the column, means for rotating the column and boom therewith, and means for pivoting the boom from a position generally parallel to the tube sheet to a position aligned with the manway. The apparatus further comprises a carriage disposed to ride lengthwise along the boom, a drive for moving the carriage lengthwise along the boom and for fixing the position of the carriage on the boom and a tool operative on a tube. A tool holder is pivotally disposed on the carriage so as to axially align the tool with the axis of a tube and to allow rotation of the tool and tool holder so that they fit through the manway. The tool holder has a device for moving the tool rectilinearly along the axis of the tube, whereby the apparatus will remotely perform repair operations on the tubes.

BRIEF DESCRIPTION OF THE DRAWINGS

The objects and advantages of this invention will become more apparent from reading the following detailed description in combination with the accompanying drawings, in which corresponding reference numerals indicate like parts throughout the drawings and in which.

DESCRIPTION OF THE PREFERRED EMBODIMENT

Figure 1:
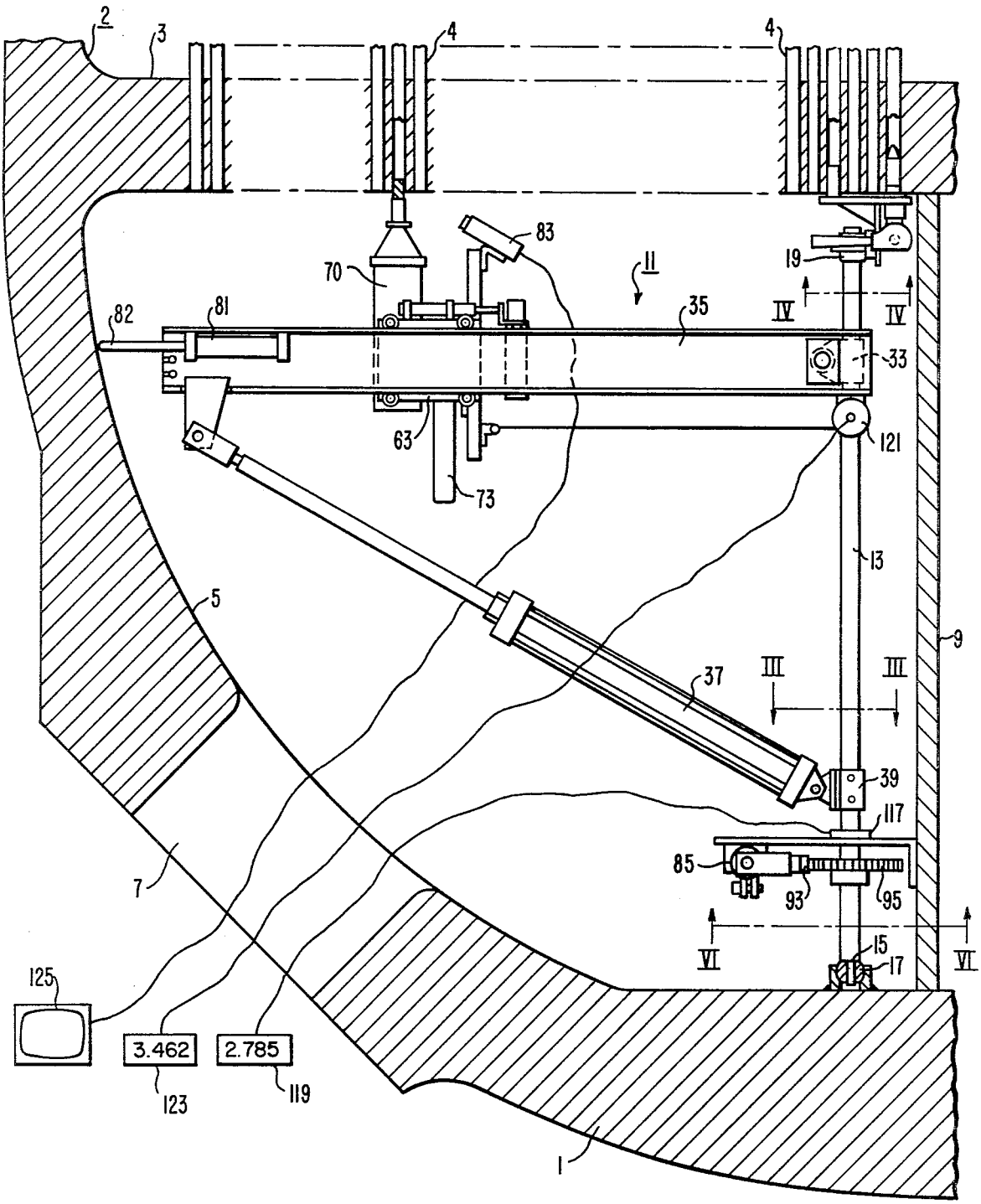
FIG. 1 is a partial sectional view of a channel head of a steam generator with apparatus for remotely repairing tubes installed therein.
Figure 2:
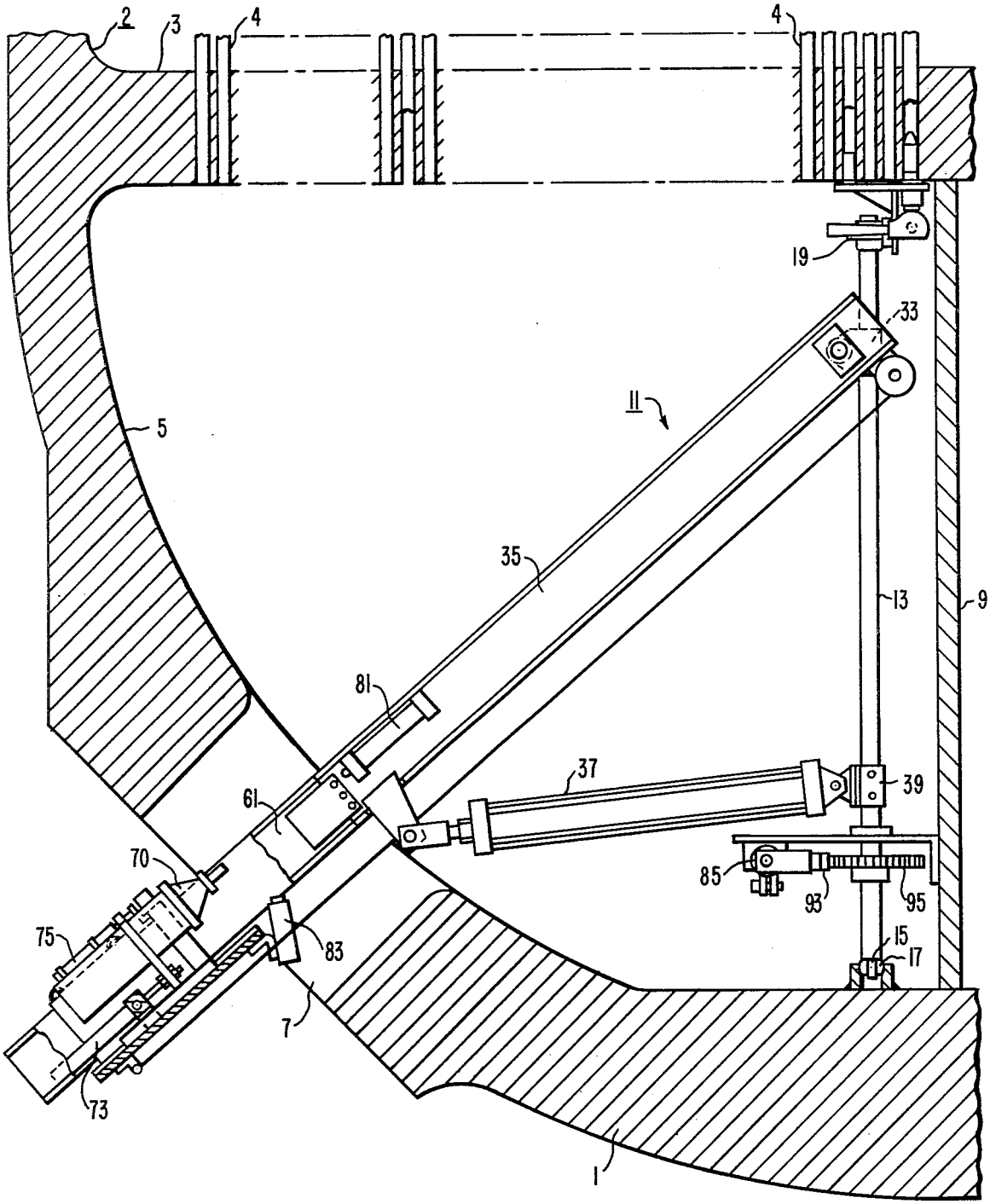
FIG. 2 is a partial sectional view of a channel head of a steam generator with the apparatus in a different position.

Referring now to the drawings in detail, and in particular to FIGS. 1 and 2, there is shown a portion of a channel head 1 of a nuclear steam generator 2 having a tube sheet 3 with a plurality of tubes 4 extending therefrom. The channel head 1 has generally spherical walls 5 and a manway 7 disposed within the walls 5 to provide access to the interior thereof. A dividing plate 9 separates the head 1 into separate inlet and outlet compartments, only one of which is shown in the drawings.

Apparatus for remotely repairing and inspecting the tubes in a nuclear steam generator is shown disposed in the channel head 1 and generally indicated by the reference numeral 11. The apparatus 11 comprises a vertically oriented column 13 disposed generally perpendicular to the tube sheet 3 and adjacent the dividing plate 9. The column 13 is a round rod rotatably mounted in a bearing adjacent each end thereof. The lower end has a step 15 which is mounted in a spherical bearing 17 fastened to the walls 5 of the head 1 by welding or other means. A pillow block 19 serves as a bearing on the upper end of the column 13.

Figure 4:
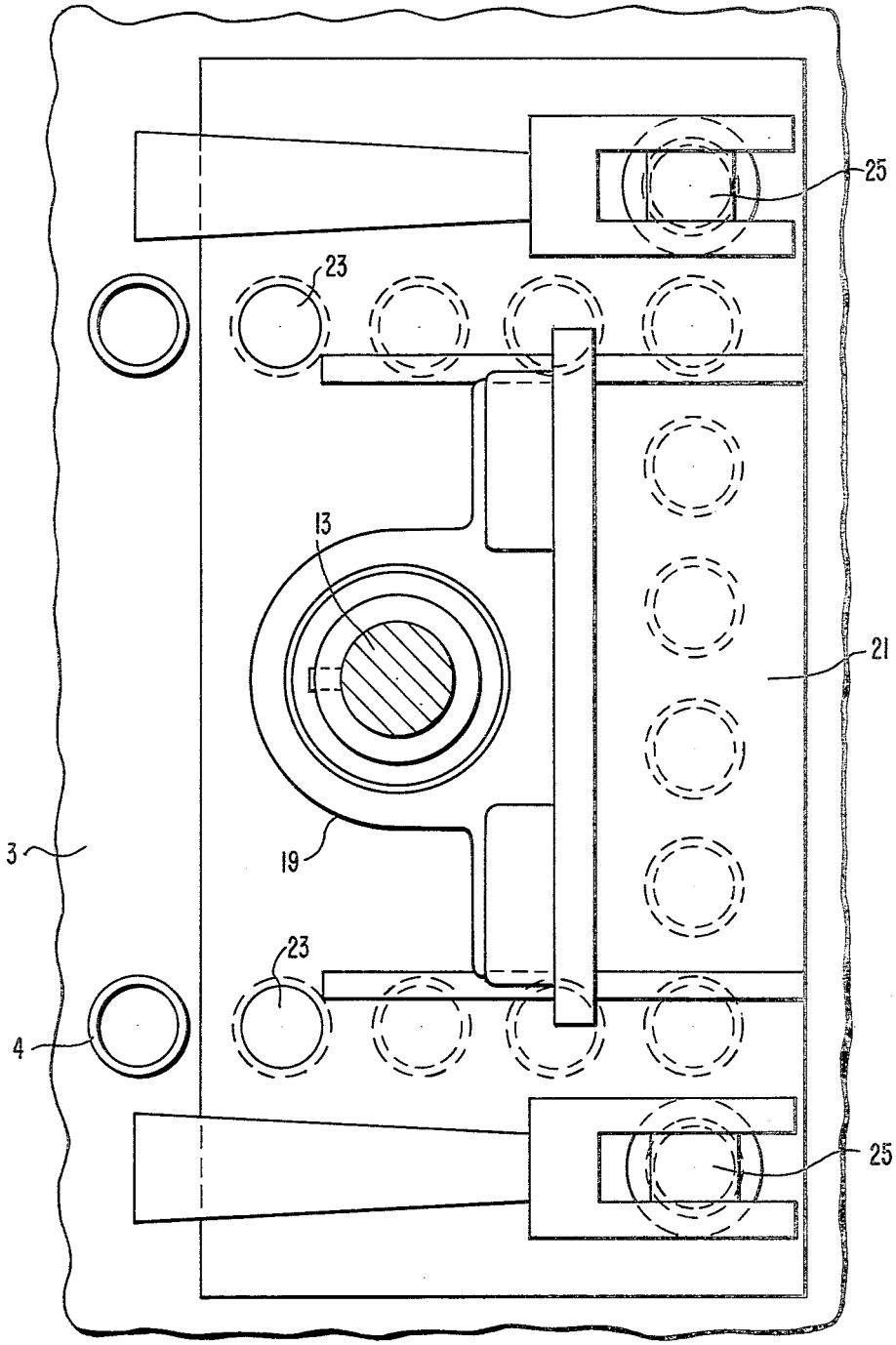
FIG. 4 is a partial sectional view taken on line IV—IV of FIG. 1.
Figure 5:
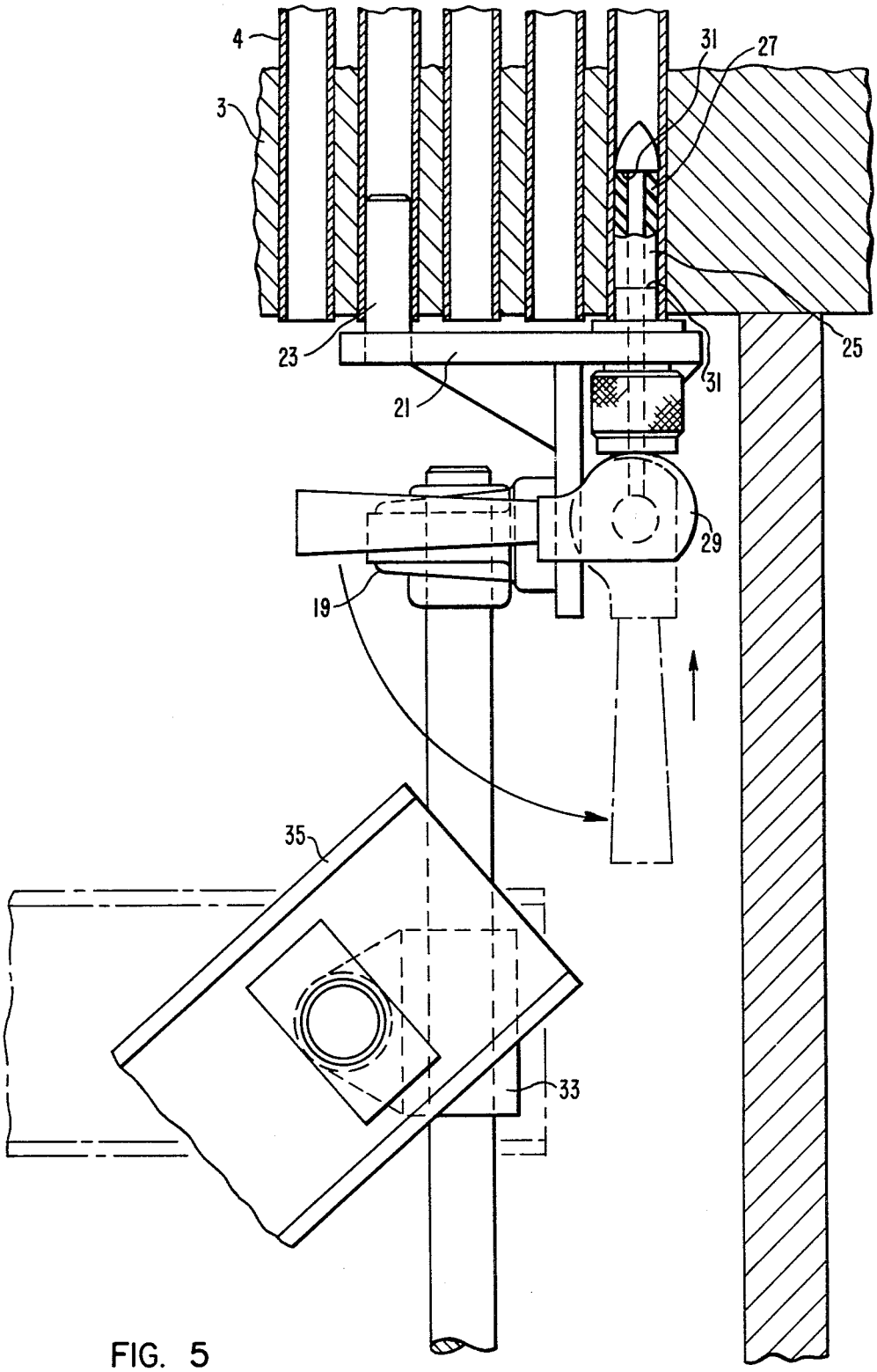
FIG. 5 is a partial sectional view taken on line V—V of FIG. 4.
Figure 8:
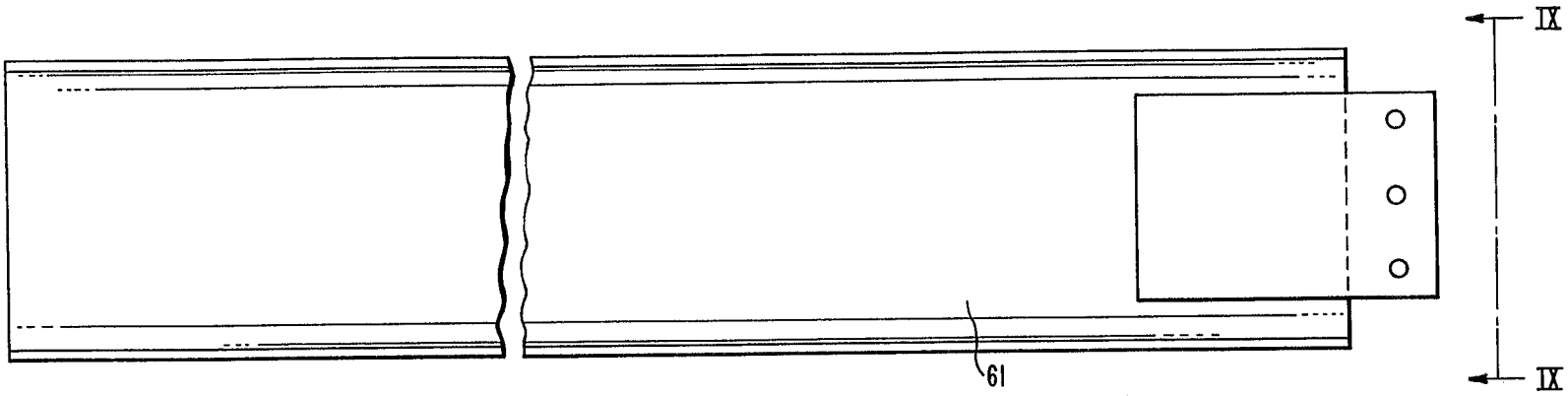
FIG. 8 is an elevational view of a boom extender made in accordance with this invention.

As shown best in FIGS. 4 and 5, the pillow block 19 is mounted on a T-shaped support bracket 21 which has a plurality of fingers 23 and 25 extending therefrom. The fingers 23 are metal pins which are slidably disposed in the tubes 4, and the fingers 25 are locking devices, which clamp tightly against the tube walls holding the support bracket 21 in the tubes 4 and in place within the head 1. The fingers 25 comprise an elastomer sleeve 27 which is compressed axially by a cam 29 between opposing surfaces 31 causing the elastomer sleeve 27 to expand radially into engagement with the tube 4 and clamp the support bracket 21 in place within the head 1.

Also shown in FIG. 5 is a boom bracket 33 mounted on the column 13; the bracket 33 is fastened to the column in such a manner that it is affixed thereto and does not move relative to the column 13. A boom 35 is pivotally mounted on the boom bracket 33 adjacent the upper end of the column 13. The boom 35, boom bracket 33 and column 13 cooperate so that the boom 35 will rotate with the column 13. The boom 35 is also pivotally mounted on the bracket 33 so that it will swing from a position generally parallel to the tube sheet 3 to a position generally aligned with the manway 7.

Figure 3:
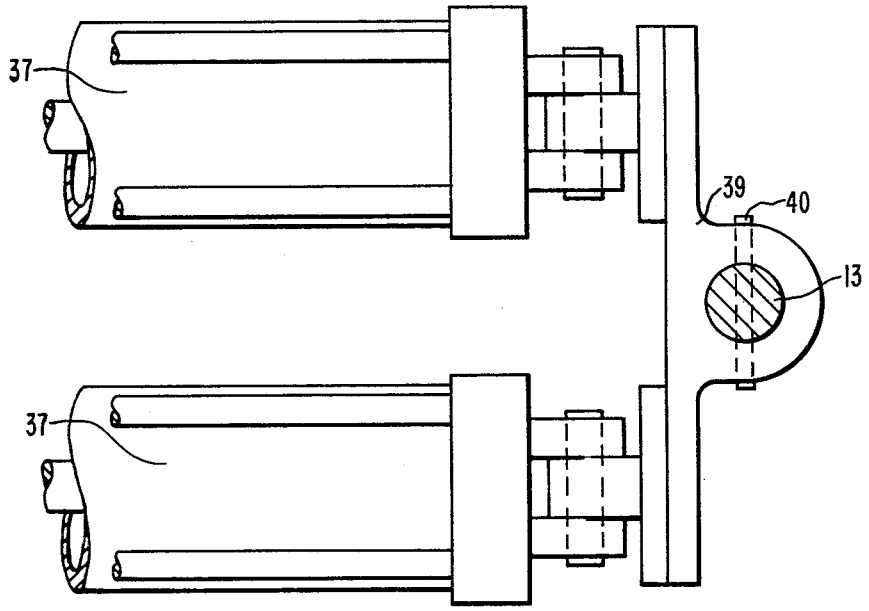
FIG. 3 is a partial sectional view taken on line III—III of FIG. 1.

A pair of telescoping cylinders 37 are connected to the lower end of the column 13 by a mounting bracket 39. As shown in FIG. 3, the mounting bracket 39 is affixed to the column 13 by a pin 40 which passes through the mounting bracket 39 and column 33 to prevent relative motion therebetween. The cylinders 37 are also connected to the distal or free end of the boom 35. In the preferred embodiment, the cylinders 37 are double acting pneumatic cylinders; however, they could be single acting cylinders as the weight of the boom 35 would cause the boom to swing downwardly, or they could also be hydraulic cylinders. Hydraulicly operated cylinders can generally be controlled more accurately; whereas, pneumatic cylinders are generally faster acting and would be preferred, when acting against stops as the latter normally utilize lower pressure working fluids. The advantages and disadvantages of the different types of working fluids is recognized; however, either could be utilized or the cylinders could be replaced with some other drive mechanism without seriously impairing the workability of the apparatus, though its efficiency may be reduced.

Figure 12:
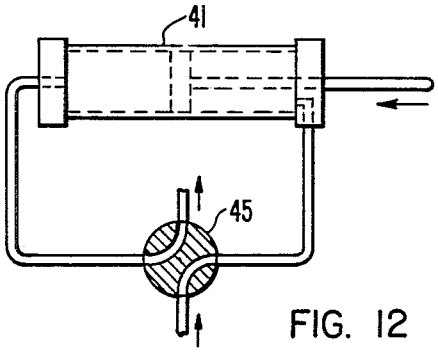
FIG. 12 is a schematic view of a double acting cylinder utilized in this invention.
Figure 13:
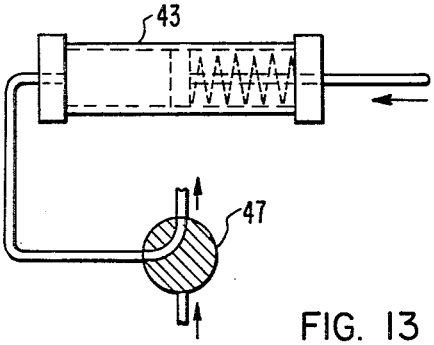
FIG. 13 is a schematic view of a single acting cylinder utilized in this invention.

FIGS. 12 and 13 schematically show a typical double acting cylinder 41 and a single acting spring return cylinder 43 and the control valves 45 and 47, respectively, utilized to operate these cylinders. It is understood that there may be preferences to utilize one type of cylinder rather than the other; however, utilizing the other or a completely different driving device would not seriously impair the workability of the apparatus described in this invention. Therefore, hereinafter the preferred cylinder and its working fluid will be set forth with the understanding that there is no attempt to limit the invention to the use of that particular cylinder or to cylinders in general as any type of drive mechanism could be utilized. The cylinders have the advantage that they use either hydraulic fluid or air as a working fluid and do not require electrical connections.

Figure 7:
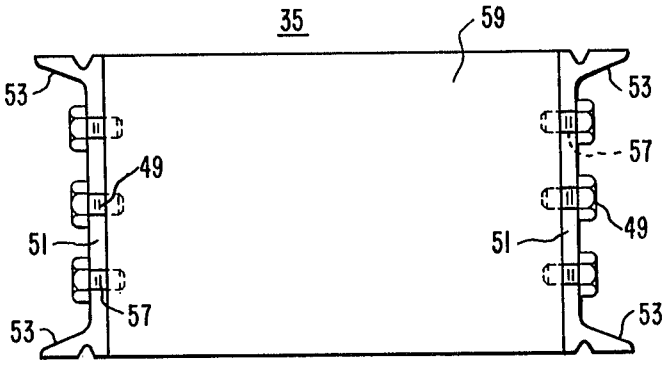
FIG. 7 is an end view of a boom.
Figure 9:
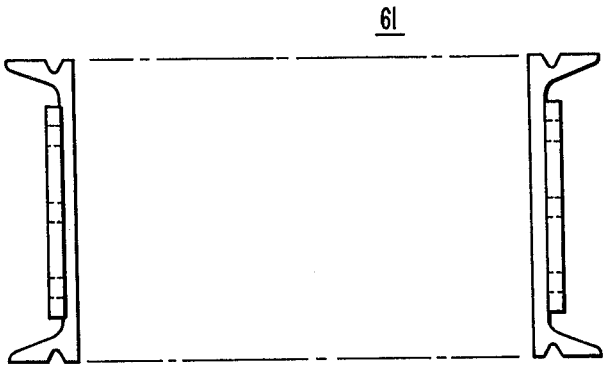
FIG. 9 is a sectional view taken on line IX—IX of FIG. 8.

As shown in FIG. 7 the boom 35 comprises a pair of channels 49 spaced apart with webs 51 disposed adjacent each other and legs 53 extending outwardly therefrom. Each channel 49 has a groove 55 on the outer portion of each leg 53 adjacent the web 51 end thereof. Each channel 49 has a plurality of slots 57 in the free end of the web 51 for attaching a spacer 59 or for attaching extension channels 61 which replace the spacer 59 and allow the boom 35 to extend through the manway 7 when the boom 35 is aligned therewith. The extensions 61 are easily slipped on and off, utilizing the slots 57.

Figure 10:
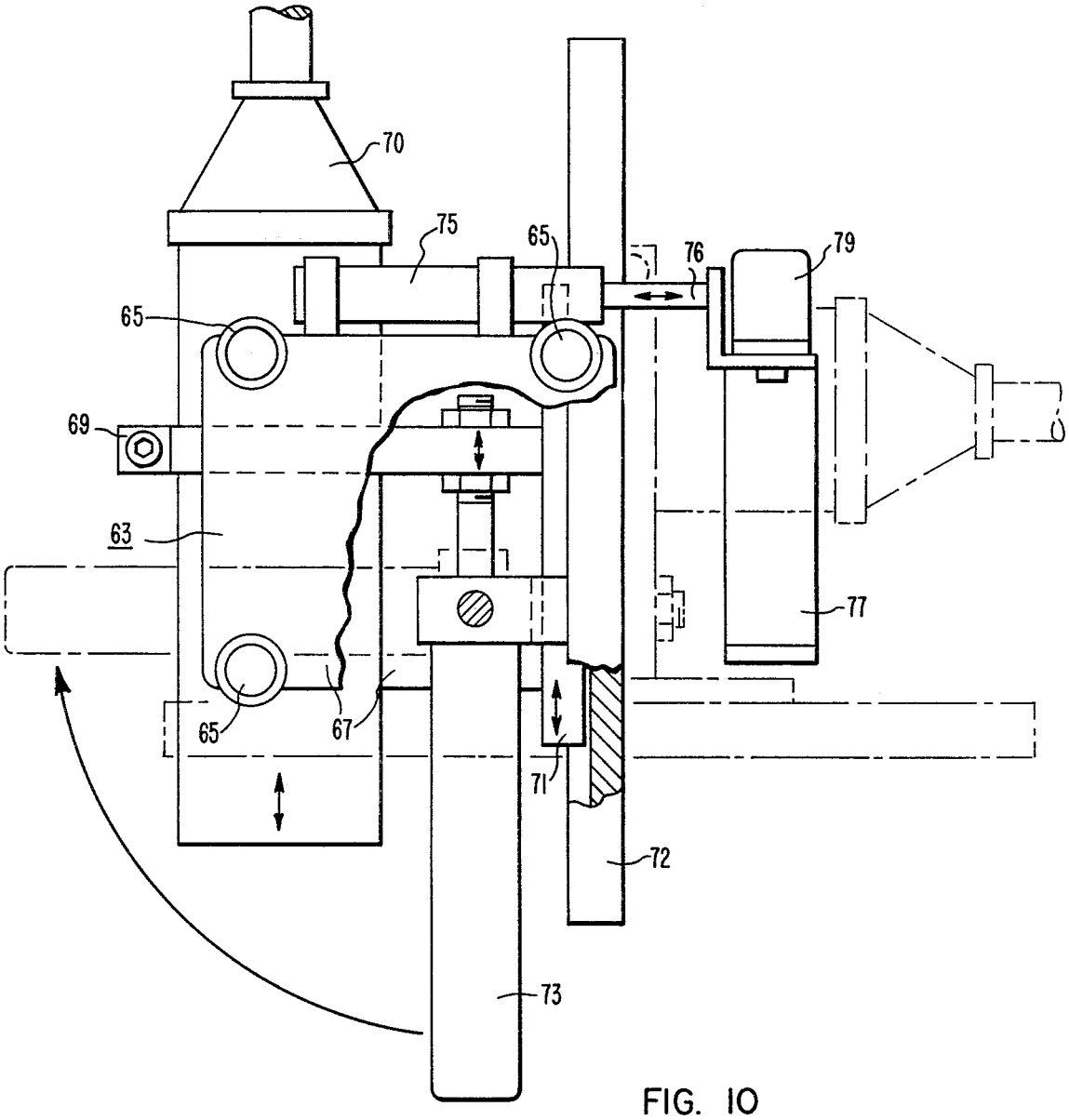
FIG. 10 is an elevational view partially in section of a carriage and tool holder made in accordance with this invention.

A carriage 63, shown best in FIG. 10, has eight wheels 65 which ride in the grooves 55, moves lengthwise or longitudinally along the boom 35, and is disposed between the channels 49. The carriage 63 comprises a pair of generally parallel side plates 67, upon which the wheels 65 are mounted. Disposed between the side plates 67 is a tool holder 69 which is pivotally mounted therebetween. The tool holder 69 is adapted to hold a variety of tools 70 and inspection devices, which are operative on the tubes 4. The tool holder 69 pivots from a position where the tools are generally axially aligned with the ends of the tubes 4 to a position where the tools are generally aligned with the manway 7 when the boom 35 is aligned with the manway 7 and the extension channels 61 are attached thereto as shown in FIG. 2 so that the carriage 63 may ride along the extension 61 and pass through the manway 7 in order to change certain tools in the tool holder 69.

The tool holder 69 further comprises a pair of transverse plates 71 and 72 dovetailed together to slide lengthwise with respect to each other and a double acting hydraulic cylinder 73 which cooperates with the dovetailed plates 71 and 72 to move a portion of the tool holder 69 rectilinearly to advance the tool 70 axially into a tube 4 and retract it therefrom. The tool holder 69 is arranged so that the tool 70 is disposed adjacent one end of the carriage 63, whereby it can operate on tubes close to the wall 5 of the head 1. The carriage can be disposed on the boom 35 with the tool 70 adjacent the leading or trailing end so that the tool 70 may operate on a maximum number of tubes 4.

Two pairs of cylinders are disposed so that there is one pair of each side of the carriage 63. Each pair of cylinders consists of a double acting hydraulic cylinder 75 disposed longitudinally or lengthwise with respect to the carriage 63 and the boom 35 and adjacent the upper end of the carriage 63. The cylinder 75 has a rod 76 which extends therefrom and is connected to a C-shaped clamp 77, which straddles the adjacent channel 49. A single acting spring return pneumatic cylinder 79 cooperates with the C-shaped clamp 77 to clamp and release the channel 49 depending on whether the cylinder 79 is activated or deactivated and is the second cylinder in each pair. A duplicate arrangement is disposed adjacent the opposite upper end of the carriage 63. By operating the pairs of cylinders intermittently, the carriage 63 can be walked in either direction lengthwise along the boom 35, and if the cylinders 79 are operated to clamp the channels 49, the carriage 63 can be held in position and moved a very small distance by the cylinders 75.

Disposed on the distal or free end of each channel 49 is a single acting pneumatic cylinder 81 which is attached thereto by a bayonet-type fastener so that it can be easily and rapidly removed and replaced in order to allow the boom 35 to move to a position adjacent the dividing plate 9 to permit the tool to operate on a maximum number of tubes. The cylinder 81 has rods 82 which extend outwardly to contact the wall 5 of the head 1 to hold the boom 35 in place as the tool 70 operates on the tube 4 to substantially increase the rigidity of the boom 35 and the quality of the tool's operation.

A TV camera 83 is disposed on either side of the carriage 63 by a quick-release device so that it may be easily and quickly moved from one side of the carriage 63 to the other or removed to allow the boom 35 to move close to the partition 9 or allow the carriage 63 to pass through the manway 7.

Figure 6:
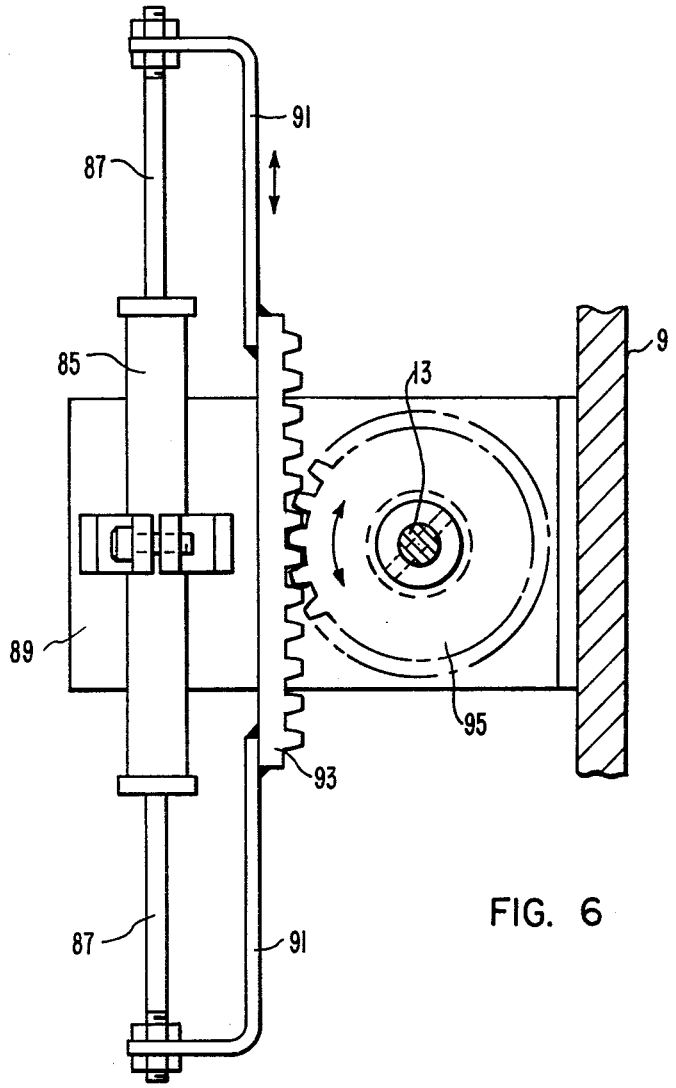
FIG. 6 is a partial sectional view taken on line VI—VI of FIG. 1.

As shown in FIG. 6, a double acting hydraulic cylinder 85 with a rod 87 extending from each end thereof is mounted to a support plate 89 which abuts the dividing plate 9. Mounting brackets 91 are fastened to each rod 87 and to each end of a rack 93. The rack 93 engages a spur or pinion gear 95, which is fastened or affixed to the column 13 by a key, pin and/or setscrew or other means. Actuating the hydraulic cylinder 85 rotates the gear 95, the column 13 and the boom 35. Since the column 13 and boom 35 can only rotate approximately 90°, the gear 95 may be a segment of a gear.

Figure 11:
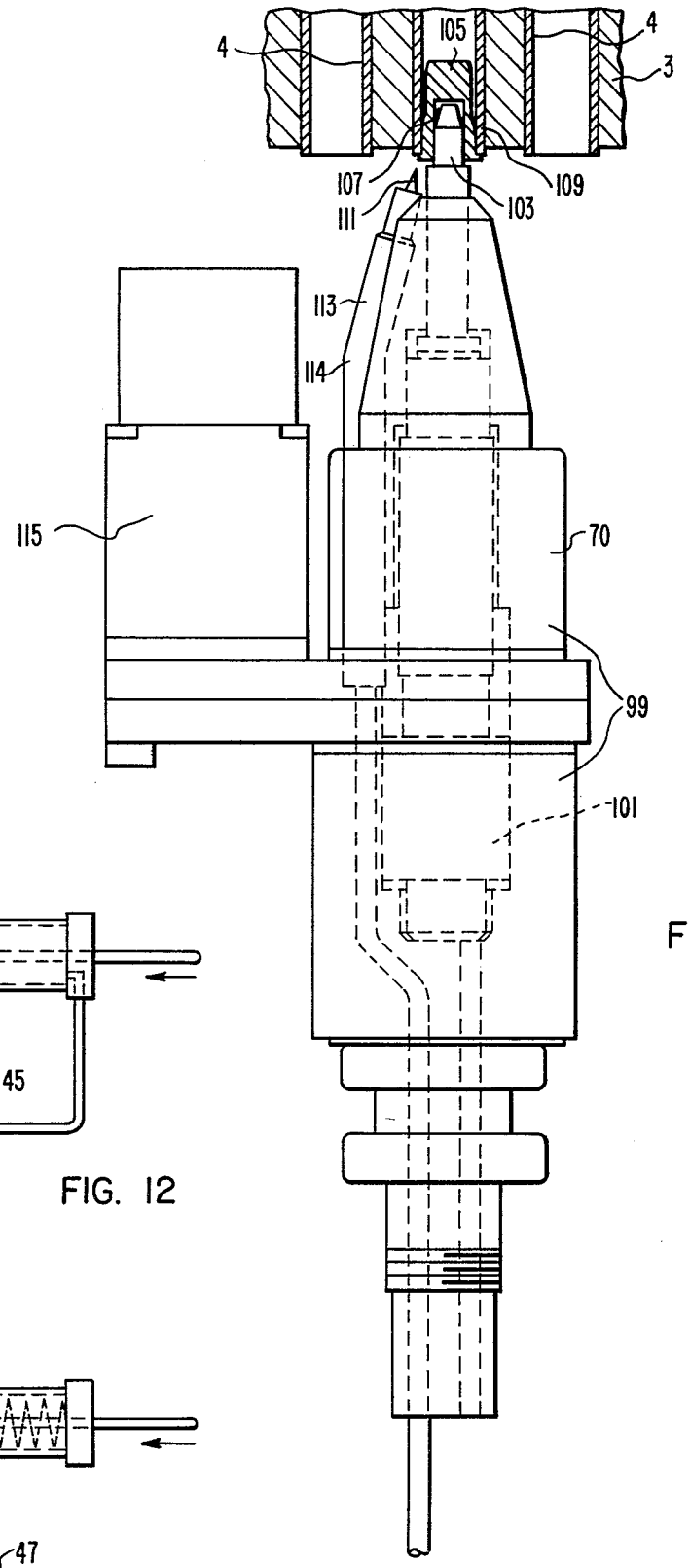
FIG. 11 is an elevational view of a tool utilized in this invention.

The tool holder 69 is adapted to hold conventional air motors or other devices capable of drilling, counterboring, countersinking, wire brushing or perform some other operation, or the tool holder may hold some special tool to perform a repair or inspection on the tube. One such special tool 70 is shown in FIG. 11 and is a pneumatic hammer and welder. The pneumatic hammer and welder 70 comprises a generally cylindrical housing 99 in which is disposed the internals of a conventional heavy duty air or pneumatic hammer 101, such as a Model 2Z487 pneumatic hammer made by the Dayton Electric Manufacturing Company of Chicago, Ill. The internals of the pneumatic hammer 101 are axially disposed within the housing 99 and a modified chisel 103 extends through the end of the housing 99 and is disposed and captured therein so that it may be struck by the free piston (not shown) of the pneumatic hammer 101. The chisel 103 has the distal end turned down so as to form a shoulder to accept a tube plug 105 which has a hole 107 centrally disposed in the trailing end. The plug 105 also has a frustoconical shaped portion 109 forming the outer surface adjacent the trailing end so that the plug may be wedged in a tube 4 with sufficient force to hold it therein. The pneumatic hammer 101 provides the necessary force to drive or wedge the plug 105 in the tube 4. To insure zero leakage, a nonconsumable welding electrode 111 and an inert gas supply system 113 are eccentrically disposed on the housing 99 to form a TIG (tungsten inert gas) welding torch 114. A driving device 115 rotates the upper portion of the housing 99 and welding torch 114 to weld the juncture between the plug 105 and the tube 4 in order to make a leakproof juncture. Since plugging a tube requires several steps and several tools, it is necessary that the various tools be placed in the tool holder and that the tool holder be able to return to a specific tube; therefore, as shown in FIG. 2, when the boom is moved to an alignment with the manway 7, the extension channels 61 are connected to the channels 49, utilizing the slots 57 to allow rapid assembly and disassembly. The tool holder 65 rotates on the carriage 63 so that the carriage 63 and the tool holder 65 can fit through the manway 7 to allow replacement of the tools. Also disposed on the column 13 is a potentiometer 117 which produces varying voltage as the column rotates. A numerical indicator 119 is connected to the potentiometer 117 to provide a numerical indication of the angular position of the column 13 and boom 35. A potentiometer 121 is disposed on the boom 35 and connected to the carriage 63 to produce a voltage which varies as the position of the carriage along the boom 35 changes. A numerical indicator 123 provides a numerical indication of the position of the carriage 63 along the boom 35 so that once a tube 4 has been located by recording the readings on the numerical indicators 119 and 123, the carriage and tool may be moved to the manway 7 or even removed through the manway 7 to facilitate tool replacement and the carriage can be easily and rapidly returned to the same tube to perform additional operations thereon. The TV camera 83 is connected to a receiver 125 to provide visual inspection of the tool 70 and the work as it progresses in order to provide an apparatus which will remotely repair and inspect tubes 4 disposed in a tube sheet 3 with a minimum exposure of maintenance personnel to radioactive deposits which collect in the steam generator during its operation.

I claim:

1. Apparatus for remotely repairing tubes disposed in a tube sheet in a channel head of a steam generator having a manway disposed in said head, said apparatus comprising:

a column rotatably disposed in said head generally perpendicular to said tube sheet;

a boom pivotally mounted on said column;

means for rotating said column and said boom therewith;

means for pivoting said boom from a position generally parallel to said tube sheet to a position generally aligned with said manway;

a carriage disposed to ride lengthwise along said boom;

means for moving said carriage lengthwise along said boom and for affixing the position of said carriage on said boom;

a tool operative on a tube;

a tool holder pivotally disposed on said carriage so as to axially align said tool with the axis of a tube and to allow rotation of the tool and tool holder so that they fit through the manway;

means for moving the tool rectilinearly, said means being disposed on said tool holder whereby said apparatus will perform repair operation on said tubes; and an extension for said boom whereby, when connected thereto, said carriage can be driven through said manway.

2. Apparatus for remotely repairing tubes disposed in a tube sheet in a channel head of a steam generator having a manway disposed in said head, said apparatus comprising:

a column rotatably disposed in said head generally perpendicular to said tube sheet;

a boom pivotally mounted on said column;

means for rotating said column and said boom therewith;

means for pivoting said boom from a position generally parallel to said tube sheet to a position generally aligned with said manway;

a carriage disposed to ride lengthwise along said boom;

a tool operative on a tube;

a tool holder pivotally disposed on said carriage so as to axially align said tool with the axis of a tube and to allow rotation of the tool and tool holder so that they fit through the manway;

means for moving said tool axially; and two pairs of cylinders cooperatively associated with two clamps, one cylinder in each pair operating the associated clamp to clamp said boom or release it and the other cylinder in each pair being utilized to move said carriage with respect to the associated clamp, whereby said carriage is affixed to or moved along said boom.

3. Apparatus as set forth in claim 1 and further comprising means for affixing the position of the boom.

4. Apparatus as set forth in claim 1 and further comprising means for indicating the angular position of the column and boom.

5. The apparatus as set forth in claim 4 and further comprising means for indicating the position of the carriage lengthwise along the boom, whereby the tool may be changed and easily and quickly returned to the proper tube.

6. The apparatus as set forth in claim 5 and further comprising a closed circuit TV wherein the carmera is mounted on the carriage.

7. The apparatus as set forth in claim 1, wherein the tool is a pneumatic hammer and welding torch, whereby it can drive a plug into a tube and form a sealed well therebetween.

8. The apparatus as set forth in claim 2, wherein the means for affixing the position of the boom is a cylinder attached to the boom and the cylinder has a piston rod which extends outwardly to contact the channel head.

9. The apparatus as set forth in claim 1, wherein the column is removably mounted in the head, whereby generally the whole apparatus can be easily removed from the head.

* * * * *